US006698031B2

(12) United States Patent
Lewis

(10) Patent No.: US 6,698,031 B2
(45) Date of Patent: Mar. 2, 2004

(54) CLOTHING COMBINATION, AS FOR FIREFIGHTER, WITH PANTS AND WITH SUSPENDERS ATTACHED IN IMPROVED WAY

(75) Inventor: Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 124 days.

(21) Appl. No.: 10/151,408

(22) Filed: May 17, 2002

(65) Prior Publication Data

US 2003/0213046 A1 Nov. 20, 2003

(51) Int. Cl.[7] ..... A41F 9/00
(52) U.S. Cl. ..... 2/340
(58) Field of Search ..... 2/340, 326, 327, 2/336, 337, 338, 79, 227, 310, 69, 81; 24/318, 319

(56) References Cited

U.S. PATENT DOCUMENTS

| | | | | | |
|---|---|---|---|---|---|
| 2,315,698 | A | * | 4/1943 | Gluckmann | 2/117 |
| 2,437,714 | A | | 3/1948 | Thomason, Jr. | |
| 3,784,987 | A | | 1/1974 | Bryant | |
| 4,481,682 | A | | 11/1984 | Hall | |
| 4,850,057 | A | | 7/1989 | Schierenbeck | |
| 4,888,830 | A | * | 12/1989 | Putnam | 2/327 |
| 4,901,408 | A | | 2/1990 | Hermann | |
| 5,129,105 | A | | 7/1992 | Kleinman | |
| 5,133,092 | A | | 7/1992 | Altinger | |
| 5,623,735 | A | * | 4/1997 | Perry | 2/327 |
| D415,331 | S | | 10/1999 | Garcia | |
| 6,105,169 | A | * | 8/2000 | Colorado | 2/81 |
| 6,163,890 | A | * | 12/2000 | Utamaru | 2/340 |
| 6,167,573 | B1 | | 1/2001 | Lewis | |
| 6,490,733 | B1 | * | 12/2002 | Casaubon | 2/81 |

* cited by examiner

*Primary Examiner*—Tejash Patel
(74) *Attorney, Agent, or Firm*—Wood, Phillips, Katz, Clark & Mortimer

(57) ABSTRACT

A combination of protective clothing, as for a firefighter, utilizes a pair of pants having a waist portion and a pair of suspenders having straps, which are attachable detachably to the waist portion. The waist portion has a plurality of horizontally extending slots, one said slot for each said strap, which slots in one contemplated embodiment are defined by strips of fabric, webbing, or other material sewn at opposite ends to the waist portion and which slots in another contemplated embodiment penetrate the waist portion and may have bound edges. Each strap when attached to the waist portion extends through an associated one of the slots, whereupon such strap is folded upwardly and is fastened releasably to itself by a fastener, such as a snap fastener, which is separated from a wearer by a portion of said strap, or such as a hook-and-loop fastener.

5 Claims, 1 Drawing Sheet

CLOTHING COMBINATION, AS FOR FIREFIGHTER, WITH PANTS AND WITH SUSPENDERS ATTACHED IN IMPROVED WAY

TECHNICAL FIELD OF THE INVENTION

This invention pertains to a clothing combination, which may be advantageously worn by a firefighter, a rescue worker, a construction worker, or an agricultural worker and which utilizes a pair of pants having a waist portion and a pair of suspenders having straps to be detachably attached to the waist portion. This invention provides an improved way to attach straps of a pair of suspenders to a waist portion of a pair of pants.

BACKGROUND OF THE INVENTION

Commonly, firefighters, rescue workers, construction workers, and agricultural workers wear pants with suspenders, which facilitate donning and doffing. As exemplified in U.S. Pat. No. 2,437,714, in U.S. Pat. No. 3,784,987, and in U.S. Pat. Des. 415,331, it is known to fasten straps of a pair of suspenders around a belt, which is worn with the pants.

As exemplified in U.S. Pat. No. 4,481,682, in U.S. Pat. No. 5,133,092, and in U.S. Pat. No. 6,026,516, it is known to utilize hook-and-loop fasteners to fasten straps of a pair of suspenders to other elements. As exemplified in U.S. Pat. No. 4,850,057, in U.S. Pat. Re. 34,094, and in U.S. Pat. No. 6,167,573, the disclosures of which are incorporated herein by reference, it is known to utilize wire fasteners, which coact with buttons on a pair of pants, to fasten straps of suspenders to the pair of pants.

SUMMARY OF THE INVENTION

This invention provides a clothing combination, which may be advantageously worn by a firefighter, a rescue worker, a construction worker, or an agricultural worker and which comprises a pair of pants having a waist portion and a pair of suspenders having straps that are attachable detachably to the waist portion. This invention contemplates that the waist portion has a plurality of horizontally extending slots, one said slot for each said strap, and that each strap when attached to the waist portion extends downwardly, through an associated one of the slots, whereupon said strap is folded upwardly and is fastened releasably to itself.

Preferably, each strap when attached to the waist portion is fastened releasably to itself by fastening means separated from a wearer by a portion of said strap. As an example, the fastening means may be snap-fastening means, which possibly comprises metall parts. Alternatively, the fastening means may be hook-and-loop fastening means, which typically does not comprise metal parts. If the fastening means comprises metal parts, which can become hot in a firefighting environment or in another hot environment, the strap portion separating the fastening means from a wearer provides some thermal insulation between those parts and the wearer.

In a preferred embodiment, each slot is defined by a strip of fabric, webbing, or other material, which strip has two opposite ends and which strip is attached, as by being sewn, at the opposite ends to the waist portion. In the preferred embodiment, each strap when attached to the waist portion extends downwardly through an associated one of the slots, between the fabric strip defining the associated one of the slots and the waist portion. In an alternative embodiment, which omits such strips, each slot penetrates the waist portion.

DETAILED DESCRIPTION OF THE ILLUSTRATED EMBODIMENTS

Figure 1:
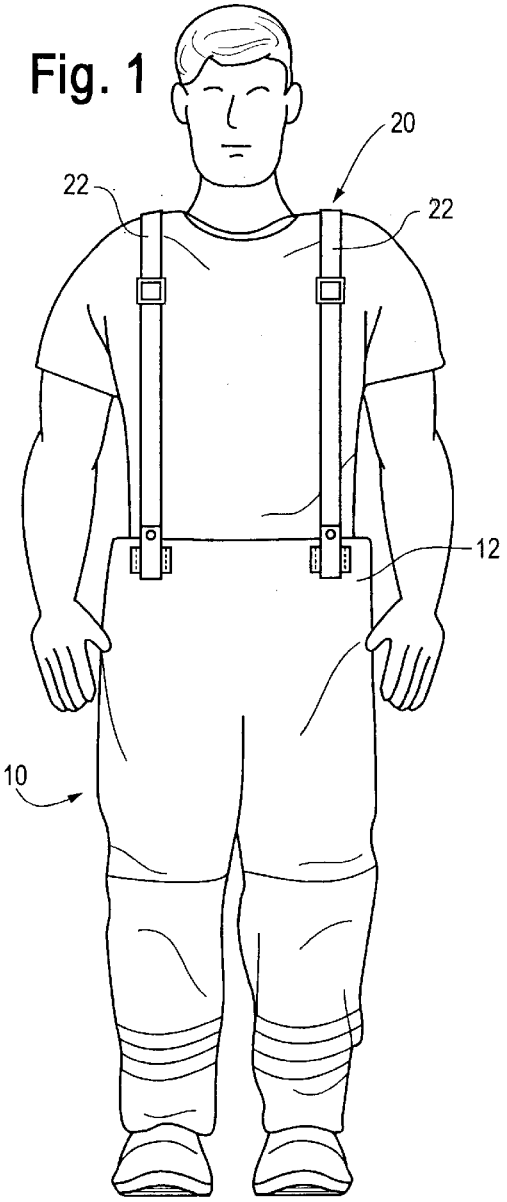
FIG. 1 is a front, perspective view of a man wearing a clothing combination, which embodies this invention. The clothing combination comprises a pair of pants having a waist portion and a pair of suspenders having straps, which are attached detachably attached to the waist portion. Each strap when attached to the waist portion extends downwardly through an associated slot, between a fabric strip defining the associated slot and the waist portion, whereupon said strap is folded upwardly and is fastened releasably to itself by snap-fastening means.
Figure 2:
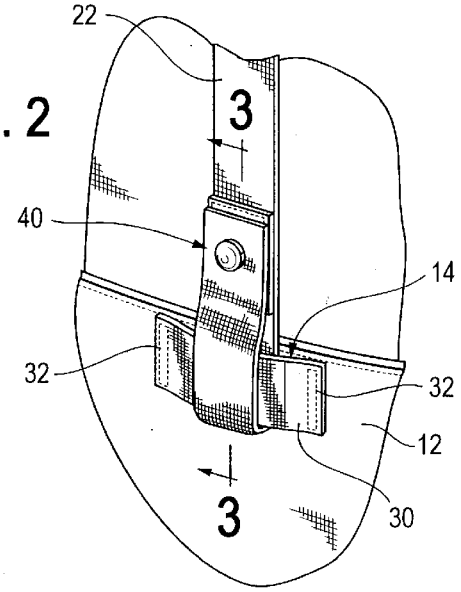
FIG. 2, on a larger scale, is a fragmentary, perspective detail of one strap extending downwardly through an associated slot, between a fabric strip defining the associated slot and the waist portion, being is folded upwardly and being fastened releasably to itself by snap-fastening means.
Figure 3:
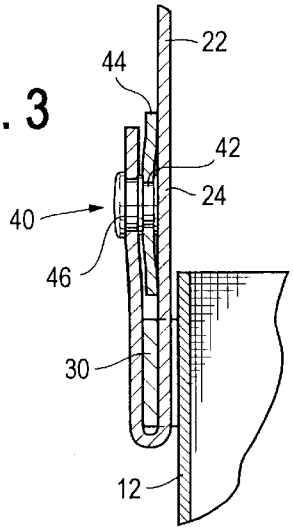
FIG. 3, on an even larger scale, is a sectional detail taken along line 3—3 of FIG. 2, in a direction indicated by arrows.

As illustrated in FIGS. 1, 2, and 3, a clothing combination constituting a preferred embodiment of this invention comprises a pair of pants 10, such as a pair of bunker pants for a firefighter, which has a waist portion 12 and two leg portions 14. The clothing combination further comprises a pair of suspenders 20 comprising two straps 22, which cross in a back portion of the pair of suspenders, as disclosed in the aforenoted patents, the disclosures of which have incorporated herein by reference. Each strap 22 has a front end and a back end, which is not illustrated, and each strap 22 is attachable detachably near each of its front and back ends to the waist portion 12 in an improved way, which is provided by this invention. This invention contemplates that the waist portion 12 has a plurality of horizontally extending slots 14, one said slot for each said strap 22, and that each strap 22 when attached to the waist portion 12 extends through an associated one of the slots 14, whereupon said strap 22 is folded upwardly and is fastened releasably to itself.

As illustrated in FIGS. 1, 2, and 3, each horizontally extending slot 14 is defined by a fabric strip 30, which has two opposite ends 32 and which is sewn at the opposite ends 32 to the waist portion 12. Moreover, each strap 22 when attached to the waist portion 12 extends downwardly through an associated one of the slots 14, between the fabric strip 30 defining the associated one of the slots 14 and the waist portion 12. After extending downwardly through an associated one of the slots 14, between the fabric strip 30 defining the associated one of the slots 14 and the waist portion 12, each strap 22 is folded upwardly and is fastened releasably to itself by a snap-fastening means 40, which is separated from a wearer by a portion 24 of said strap 22.

As illustrated in FIGS. 1, 2, and 3, the snap-fastening means 40 comprises a male member 42, which is attached in a conventional way to a fabric strip 44 affixed, as by sewing, to the same portion 24 of said strap 22, and the snap-fastening means 40 comprises a female member 46, which is affixed in a conventional way to said strap 22, near its end being attached. If the male member 42 and the female member are metal parts, which can become hot in a fire-fighting environment or in another hot environment, the strap portion 24 separating the snap-fastening means 40 from the wearer provides some thermal insulation between those parts and the wearer.

Figure 4:
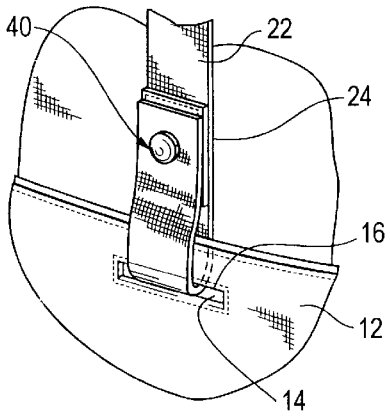
FIG. 4, on a scale like the scale of FIG. 2, is a fragmentary, perspective detail of one strap extending downwardly through an associated slot, between a fabric strip defining the associated slot and the waist portion, being is folded upwardly, and being fastened releasably to itself by hook-and-loop fastening means.

As illustrated in FIG. 4, each horizontally extending slot 14 penetrates the waist portion 12 and has bound edges 16, which resist unraveling of the waist portion 12 where penetrated by said slot 14. Moreover, each strap 22 when attached to the waist portion 12 extends outwardly through an associated one of the slots 14, between the fabric strip 30 defining the associated one of the slots 14 and the waist portion 12. After extending outwardly through an associated one of the slots 14, each strap 22 is folded upwardly and is fastened releasably to itself by a snap-fastening means 40, which is separated from a wearer by a portion 24 of said strap 22, as described above.

Figure 5:
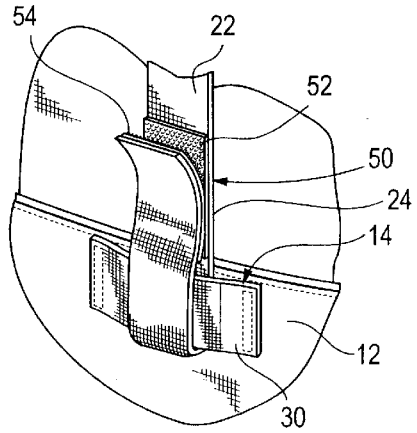
FIG. 5, on a scale like the scale of FIG. 2 and of FIG. 4, is a fragmentary, perspective detail of one strap extending downwardly through an associated slot, which penetrates the waist portion and which has bound edges, being is folded upwardly and being fastened releasably to itself by snap-fastening means.

As illustrated in FIG. 5, the embodiment illustrated in FIGS. 1, 2, and 3 and described above, may be modified so that, after extending downwardly through an associated one of the slots 14, between the fabric strip 30 defining the associated one of the slots 14 and the waist portion 12, each strap 22 is folded upwardly and is fastened releasably to itself by a hook-and-loop fastening means 50, which comprises a hook-faced tape 52 affixed, as by sewing, to the strap portion 24 mentioned above and a loop-faced tape 54 affixed, as by sewing, to said strap 22, near its ends being attached.

Moreover, the hook-and-loop fastening means 50 is useful in the embodiment of FIG. 4, as a substitute for the snap-fastening means 40. In the hook-and-loop fastening means 50, as utilized in any embodiment disclosed herein, the hook-faced tape 52 and the loop-faced tape 54 are interchangeable.

What is claimed is:

1. A clothing combination comprising a pair of pants having a waist portion and a pair of suspenders having straps, which are attachable detachably to the waist portion, wherein the waist portion has a plurality of horizontally extending slots, one said slot for each said strap, wherein each slot is defined by a horizontally extending strip of fabric, webbing, or other material, wherein the strip has two opposite ends and is attached at the opposite ends to the waist portion, and wherein each strap when attached to the waist portion extends through an associated one of the slots, between the fabric strip defining the associated one of the slots and the waist portion, whereupon said strap is folded upwardly and is fastened releasably to itself.

2. The clothing combination of claim 1 wherein each strap when attached to the waist portion is fastened releasably to itself by fastening means separated from a wearer by a portion of said strap.

3. The clothing combination of claim 1 wherein each strap when attached to the waist portion is fastened releasably to itself by snap-fastening means.

4. The clothing combination of claim 1 wherein each strap when attached to the waist portion is fastened releasably to itself by hook-and-loop fastening means.

5. The clothing combination of claim 3 or claim 4 wherein the fastening means used to fasten each strap releasably to itself is separated from a wearer by a portion of said strap.

* * * * *